US006504120B2

(12) United States Patent
Hsu

(10) Patent No.: US 6,504,120 B2
(45) Date of Patent: Jan. 7, 2003

(54) PUSH-BUTTON SWITCH

(75) Inventor: Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/821,284

(22) Filed: Mar. 29, 2001

(65) Prior Publication Data

US 2001/0027914 A1 Oct. 11, 2001

(30) Foreign Application Priority Data

Apr. 7, 2000 (TW) ..... 89205519 U

(51) Int. Cl.[7] ..... H01H 13/70
(52) U.S. Cl. ..... 200/344
(58) Field of Search ..... 200/344, 406–409, 200/449

(56) References Cited

U.S. PATENT DOCUMENTS 4,739,127 A * 4/1988 Higuchi et al. ..... 200/5 R
4,751,352 A * 6/1988 Botz et al. ..... 200/6 BB
5,268,545 A * 12/1993 Bruner ..... 200/345
5,964,341 A * 10/1999 Tsai ..... 200/344
2001/0002647 A1 * 6/2001 Hayashi et al. ..... 200/344
2001/0007301 A1 * 7/2001 Sato et al. ..... 200/344

FOREIGN PATENT DOCUMENTS

JP 6-20556 * 1/1994

* cited by examiner

*Primary Examiner*—Lincoln Donovan
*Assistant Examiner*—Lisa N. Klaus
(74) *Attorney, Agent, or Firm*—Ladas & Parry

(57) ABSTRACT

The push-button switch has a base plate, a circuit membrane, a key cap, a scissors-type linkage and a resilient element. The scissors-type linkage haying a first linking bracket and a second linking bracket is disposed between the circuit membrane and the key cap and movable along a specified path. The resilient element is mounted on the scissors-type linkage so as to move the key cap and the scissors-type linkage back to the initial state as the force applied on the key cap is released. The scissors-type linkage is provided with a guiding portion thereon, and the resilient element has a trigger, which is actuated by the guiding portion and used to trigger the switch as the key cap is fully pressed. The resilient element also can be a V-shaped reed connected to the first linking bracket and the second linking bracket, or the resilient element can be a spring connected to the first linking bracket and the second linking bracket.

14 Claims, 9 Drawing Sheets

2–2

PUSH-BUTTON SWITCH

BACKGROUND OF THE INVENTION

1. Field of the Invention

The present invention relates to a push-button switch mechanism. More specifically, the invention relates to a scissors-type push-button switch comprising a resilient element used to dynamically move a key cap back to the initial state and actuate a switch of a circuit membrane of a keyboard.

2. Description of Related Art

In general, a dome or the like made of rubber is the essential part of a keyboard. The dome is a resilient element used to dynamically move a key cap back to the initial state and used to actuate a switch of a circuit membrane. The dome has to be precisely positioned relative to the site of the switch and the key cap, so that the switch can be properly deformed by the -pressed key cap and then the switch can be precisely turned on.

SUMMARY OF THE INVENTION

Accordingly, it is an object of the present invention to provide a push-button switch that solves the above problem by providing a push-button assembly in which the trigger process can be precisely done by a simple pushing action.

The present invention achieves these objects by providing a push-button switch comprising a base plate, a circuit membrane, a key cap, a scissors-type linkage and a resilient element. The base plate has at least a first slide-guiding slot and two first bearing slots formed on its surface, and the circuit membrane is disposed on the base plate and provided with at least one switch. The key cap having an underside provided with a second slide-guiding slot and a second bearing slot formed on the underside. The scissors-type linkage is disposed between the circuit membrane and the base plate and is movable along a specified path between a first position and a second position. The scissors-type linkage has a guiding portion, a first linking bracket provided with at least a first end connected to the first bearing slot and at least a second end connected to the second slide-guiding slot, a second linking bracket coupled with the first linking bracket and provided with at least a third end connected to the first slide-guiding slot and at least a fourth end connected to the second bearing slots. The resilient element, mounted on the scissors-type linkage and used to dynamically move the key cap from the second position to the first position, has a trigger actuated by the guiding portion and used to trigger the switch while the key cap is moved toward the second position.

When the force is applied on the key cap, the key cap is moved toward the switch and the scissors-type linkage is actuated. The scissors-type linkage acts like the movement of scissors moving along the certain path from the first position to the second position in reference to the site of the pivotal axis. At the same time, the cantilever arm is pushed by the guiding portion of the scissors-type linkage and the arc portion is elastically deformed. Then, the trigger is finally pressed on and turns on the switch of the circuit membrane when the pivotal axis arrives at the second position. When the force is released, the deformed arc portion is immediately returned to the initial state and releases the stored energy to dynamically push the scissors-type linkage back to the initial state, and the switch is immediately turned off as the trigger is removed.

BRIEF DESCRIPTION OF THE DRAWINGS

Other objects, features, and advantages of the present invention will become apparent from the following detailed description of the preferred but non-limiting embodiment. The description is made with reference to the accompanying drawings in which.

DETAILED DESCRIPTION OF THE PREFERRED EMBODIMENT

First Embodiment

Figure 1A:
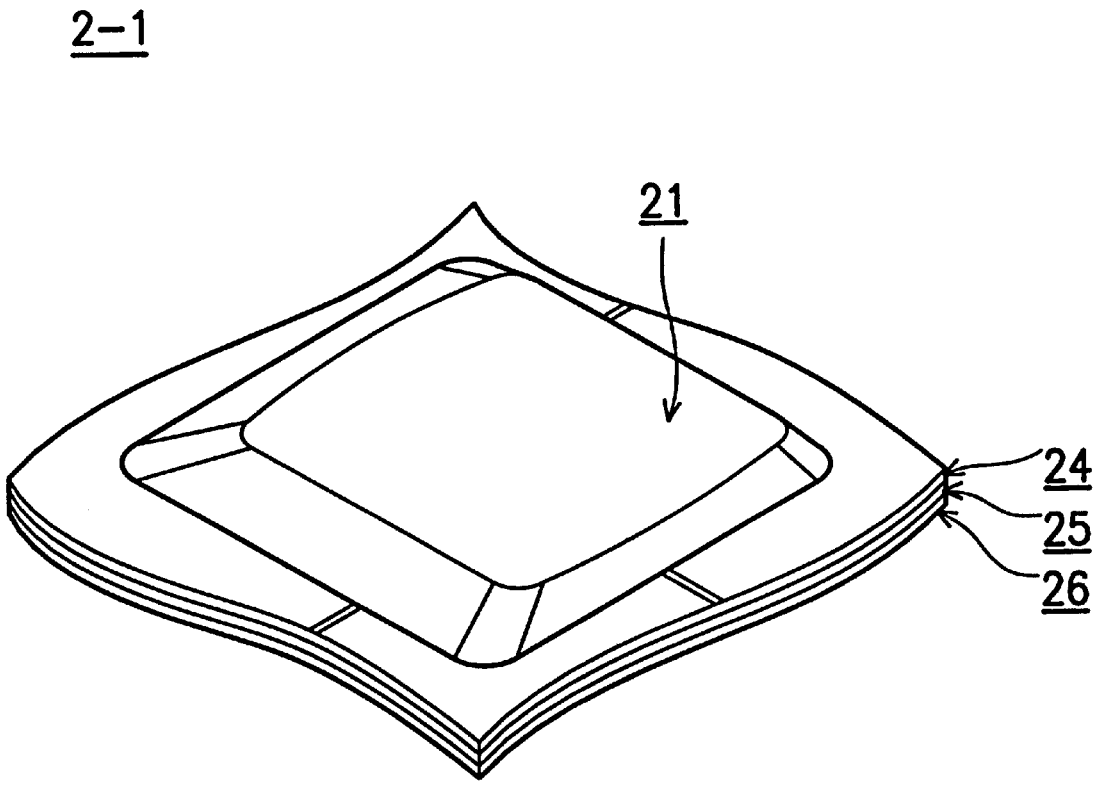
FIG. 1A is a perspective view showing the outer structure of a single key assembly (2-1) sketched from a keyboard (not shown) according to a first embodiment of the present invention.
Figure 1B:
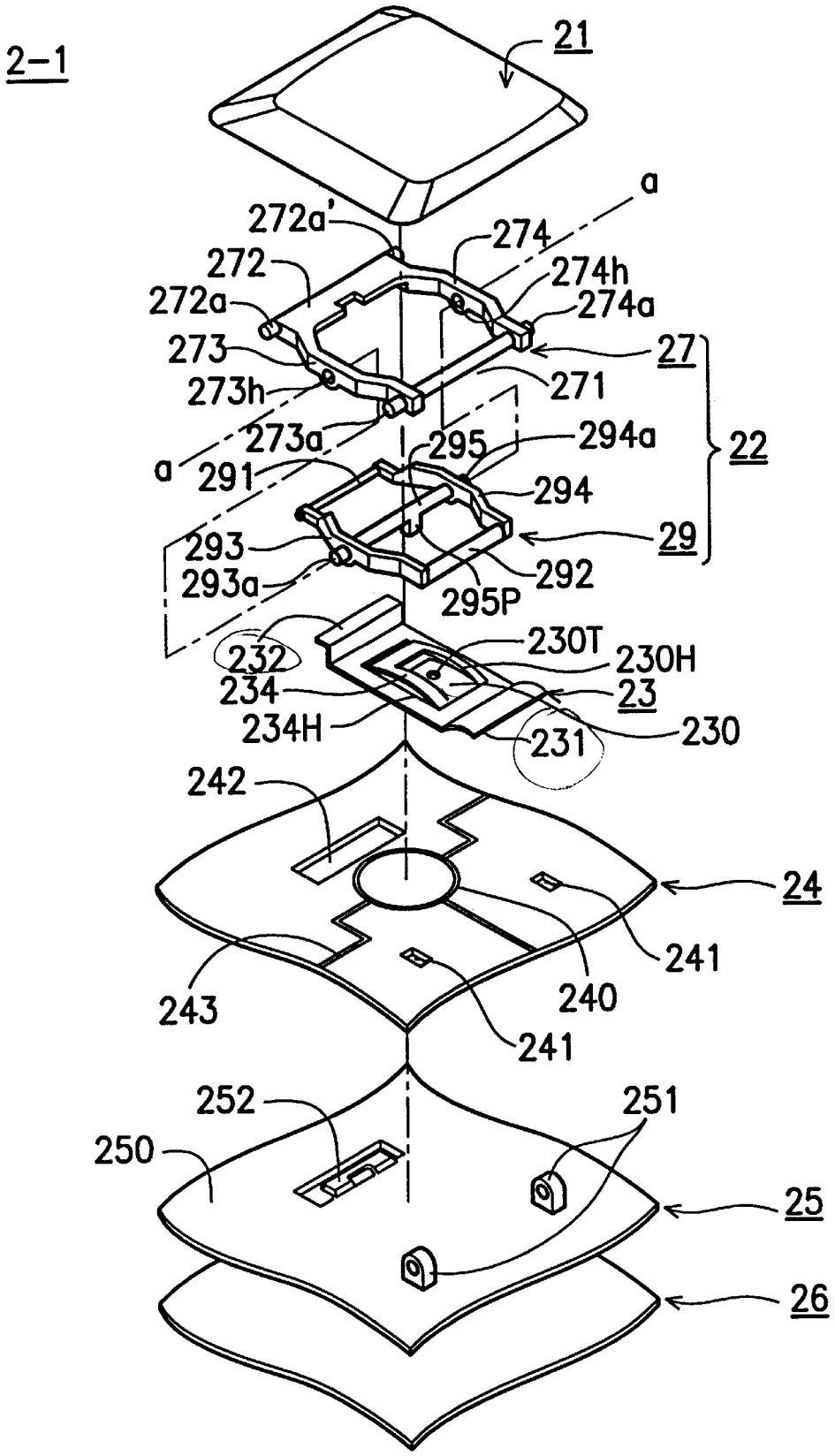
FIG. 1B is a perspective view showing all the elements of the a key assembly (2-1) according to FIG. 1A, which comprises a key cap (21), a scissors-type linkage (22), a resilient element (23), a circuit membrane (24) and a base plate (25)

Referring to FIGS. 1A and 1B, FIG. 1A is a perspective view showing the outer structure of a key assembly 2-1 which forms a part of a keyboard (not shown), FIG. 1B is a perspective view showing all the elements of the a key assembly 2-1 according to FIG. 1A.

In FIG. 1B, the key assembly 2-1 is a push-button switch device and comprises a key cap 21, a scissors-type linkage 22, a U-shaped resilient element 23, a circuit membrane 24, a base plate 25 and a holding plate 26. The base plate 25 has a base surface 250 formed with two first bearing slots 251, 251 and a first slide-guiding slot 252. The circuit membrane 24, a thin film flexible circuit device used to dispose on the base plate 25, is provided with several switch 240 electrically connected with leads 243 and formed with two first holes 241 (241) and a second hole 242. Two first bearing slots 251 (251) and the first slide-guiding slot 252 of the base plate 25 can be respectively received in the two first holes 241 (241) and the second hole 242 when the circuit membrane 24 is placed thereon.

The resilient element 23 is a metal reed formed by pressing and is provided with a cantilever arm 230, two mounting ports 231 (232) and an arc portion 234. The cantilever arm 230 is formed with a trigger 230T used for turning on/off the switch 240 of the circuit membrane 24, and the cantilever arm 230 and the arc portion 234 is formed by pressing two slots 230H, 234H on the resilient element 23.

Figure 4A:
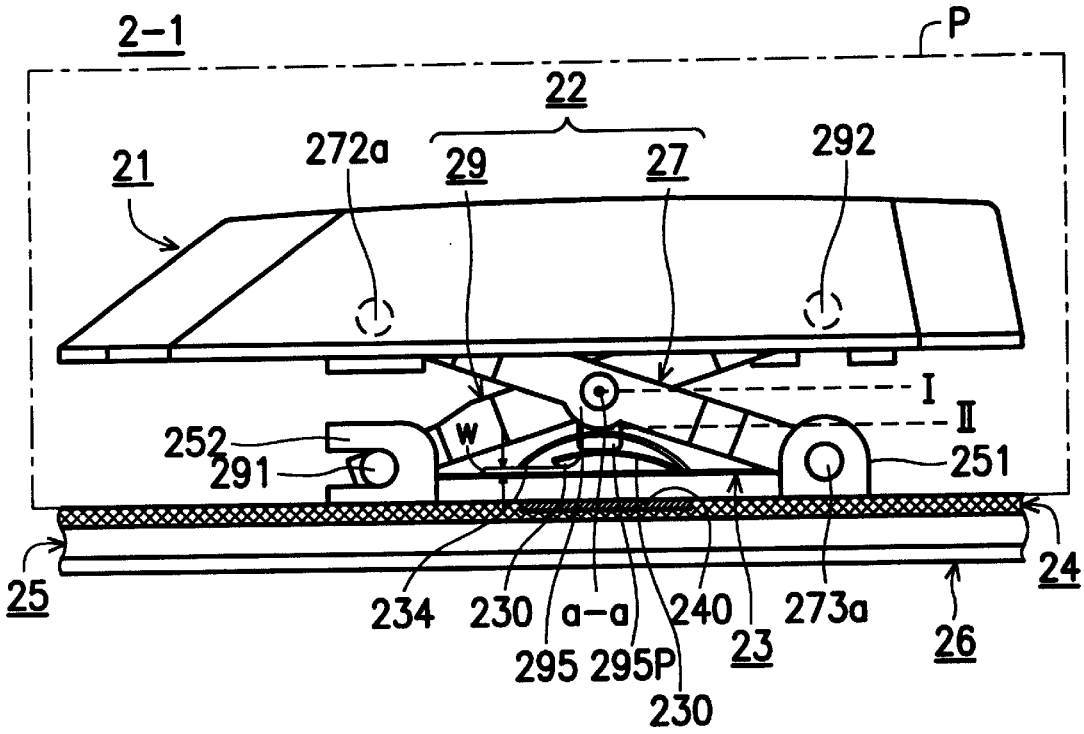
FIG. 4A is a side view showing the assembled key assembly (2-1) according to FIG. 1A.
Figure 4B:
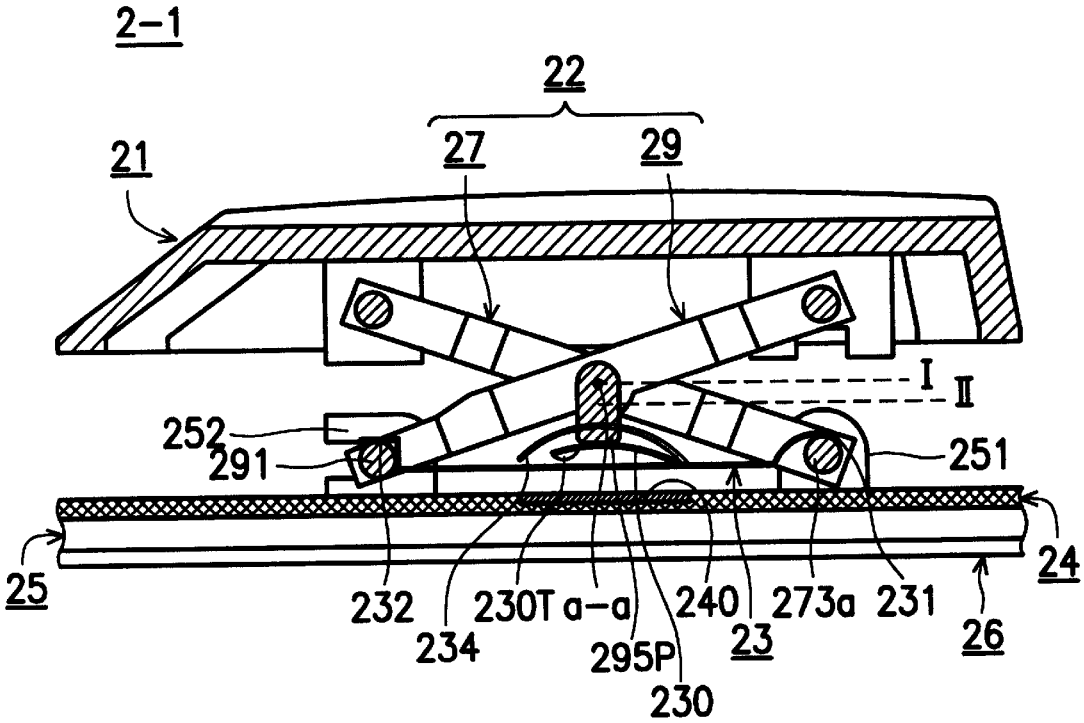
FIG. 4B is a cross-sectional view showing the inner structure of the assembled key assembly (2-1) by a plane (P) of FIG. 4A.

The scissors-type linkage 22 is used to dispose between the key cap 21 and the base plate 25 so as to move the key cap 21 along a specified path between a first position I and a second position II (FIGS. 4A and 4B). The scissors-type linkage 22 comprises a first linking bracket 27 and a second linking bracket 29, which are coupled with each other along a pivotal axis a—a.

The first linking bracket 27 is a loop element integrally formed by four bars 271, 272, 273 and 274, and the bars 273 and 274 are connected between the bars 271 and 272. Two posts 272*a*, 272*a*' extend from the two ends of the bar 272, and two posts 273*a*, 274*a* extend from the two ends of the bar 271. At the middle of the bars 273 and 274, two through holes 273*h*, 274*h* are provided. The second linking bracket 29 is integrally formed by five bars 291, 292, 293, 294 and 295, and the bars 293 and 294 are connected between the bars 291 and 292, and the bar 295 is connected between the bars 293, 294 and located between the bars 291 and 292. Two posts 293*a*, 294*a* extend from the two ends of the bar 295, and a guiding portion 295P is formed at the middle of the bar 295. The first linking bracket 27 and the second linking bracket 29 are coupled to each other by engaging the post 293*a* with the through hole 273*h* and engaging the post 294*a* with the through hole 274*h*.

Figure 2:
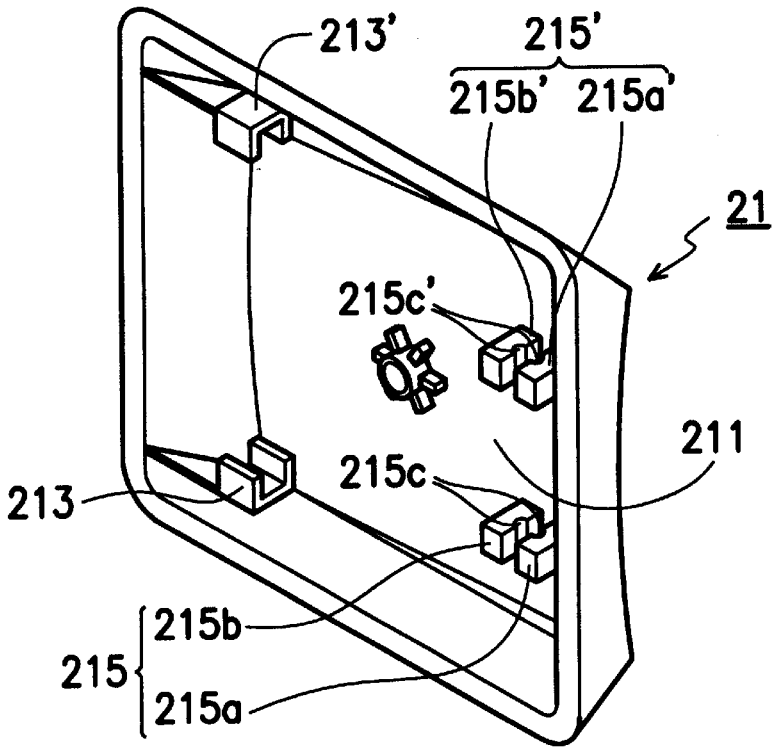
FIG. 2 is a perspective view showing the inner structure of the key cap (21) according to FIG. 1B.

Referring to FIG. 2, a perspective view shows that the inner structure of the key cap 21 according to FIG. 1B. The key cap 21 has an underside 211 and provided with dual second slide-guiding slots 213 (213') and dual second bearing slots 215, 215'. The dual second slide-guiding slots 213 (213') and the dual second bearing slots 215, 215' are spaced apart from each other and protrude from the underside 211. The second bearing slot 215 (215') is composed of two spaced protrusions 215*a* and 215*b* (215*a*' and 215*b*'), and there are two opposite recesses 215*c* and 215*c* (215*c*' and 215*c*') respectively formed on the protrusions 215*a* and 215*b* (215*a*' and 215*b*').

The scissors-type linkage 22 has four parts: a first end (posts 273*a*, 274*a*), a second end (posts 272*a*, 272*a*'), a third end (bar 291) and a fourth end (bar 292) to be connected to the key cap 21 and the base plate 25. The first end (posts 273*a*, 274*a*) is used to pivotally connect to the two first bearing slots 251, 251 of the base plate 25, and the second end (posts 272*a*, 272*a*') is used to movably connect to the second slide-guiding slots 213 (213') of the key cap 21. The third end (bar 291) is used to movably connect to the first slide-guiding slot 252 of the base plate 25, and the fourth end (bar 292) is used to pivotally connect to the second bearing slots 215, 215'.

Figure 3:
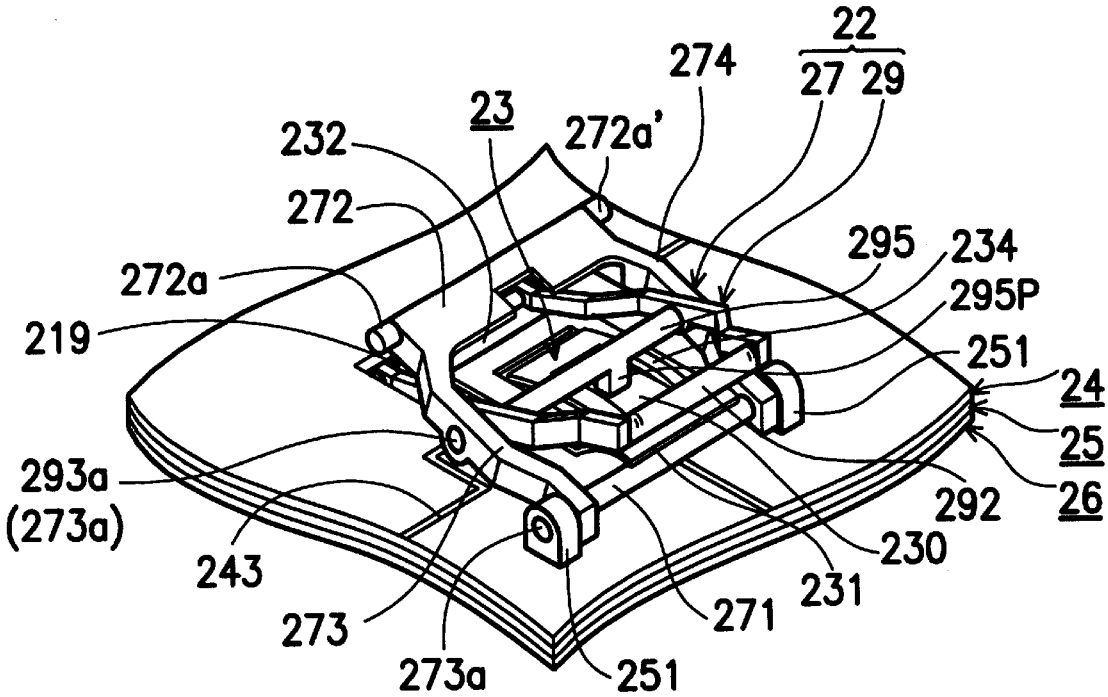
FIG. 3 is a perspective view showing the assembled key assembly (2-1) by taking off the key cap (21) from FIG. 1A.

For ease of illustrating the relationships between the scissors-type linkage 22 and the resilient element 23, the key cap 21 is removed as shown in FIG. 3. The resilient element 23 is disposed on the circuit membrane 24 and is attached to the bars 271, 291 of the scissors-type linkage 22 through two mounting ports 231, 232. Then, the cantilever arm 230 of the resilient element 23 is initially pressed by the guiding portion 295P of the scissors-type linkage 22, and the arc portion 234 of the resilient element 23 is initially pressed by the bar 295 of the scissors-type linkage 22.

In FIG. 4A, a side view-shows the assembled key assembly 2-1 according to FIG. 1A, in which the relationships between the scissors-type linkage 22 and the resilient element 23 are clearly seen. The trigger 230T of the cantilever arm 230 is disposed above the switch 240 of the circuit membrane 24 with a distance and used to turn it on/off.

Figure 4C:
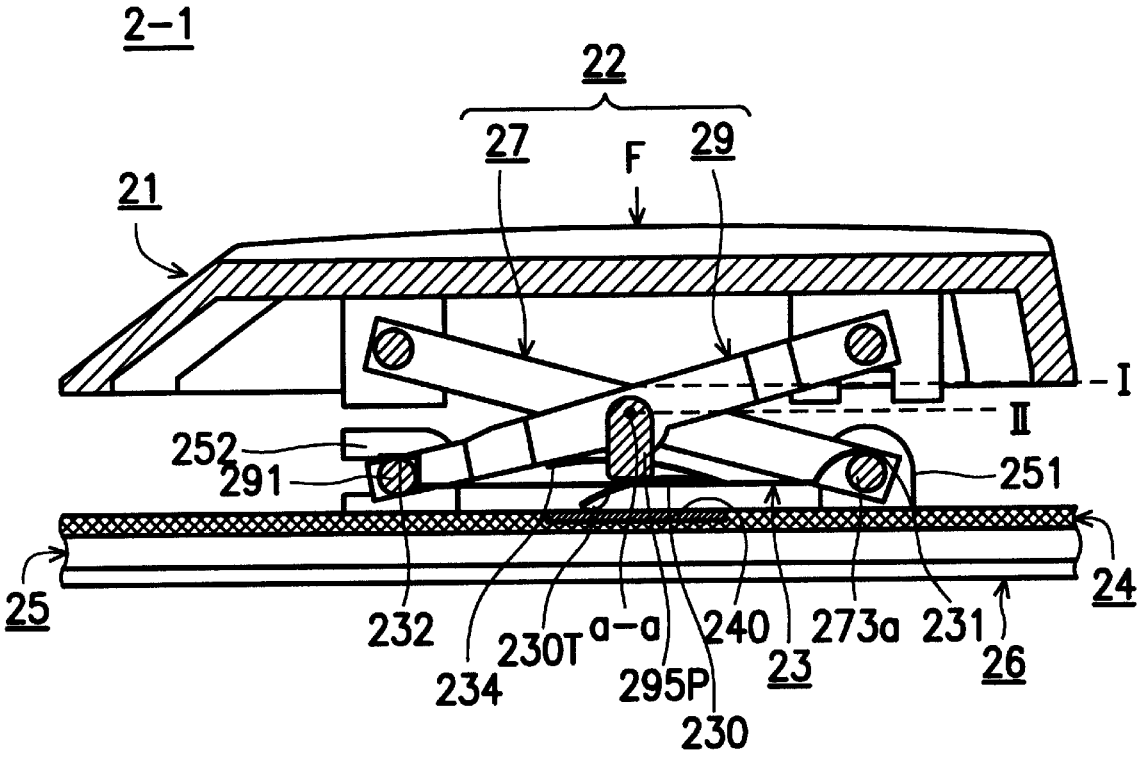
FIG. 4C is a plan view showing the assembled key assembly (2-1) being pressed by a force (F) according to FIG. 4A.

FIG. 4B is a cross-sectional view showing the inner structure of the key assembly 2-1 by a plane P of FIG. 4A, and FIG. 4C is a plain view showing the key cap 21 being pressed by a force F according to FIG. 4A.

When the force F is applied on the key cap 21, the key cap 21 is moved toward switch 240 and the scissors-type linkage 22 is actuated. The scissors-type linkage 22 acts like the movement of a scissors moving along a certain path from the first position I to the second position 11 in reference to the site of the pivotal axis a—a (instantaneous center). At the same time, the cantilever arm 230 is pushed by the guiding portion 295P of the scissors-type linkage 22 and the arc portion 234 is elastically deformed. Then, the trigger 230T is finally pressed on and turns on the switch 240 of the circuit membrane 24 when the pivotal axis a—a arrives at the second position II. When the force F is removed, the deformed arc portion 234 immediately returns to the initial state and releases the stored energy to dynamically push the scissors-type linkage 22 back to the initial state, and the switch 240 is immediately turned off when the trigger 230T is removed.

Second Embodiment

Figure 5A:
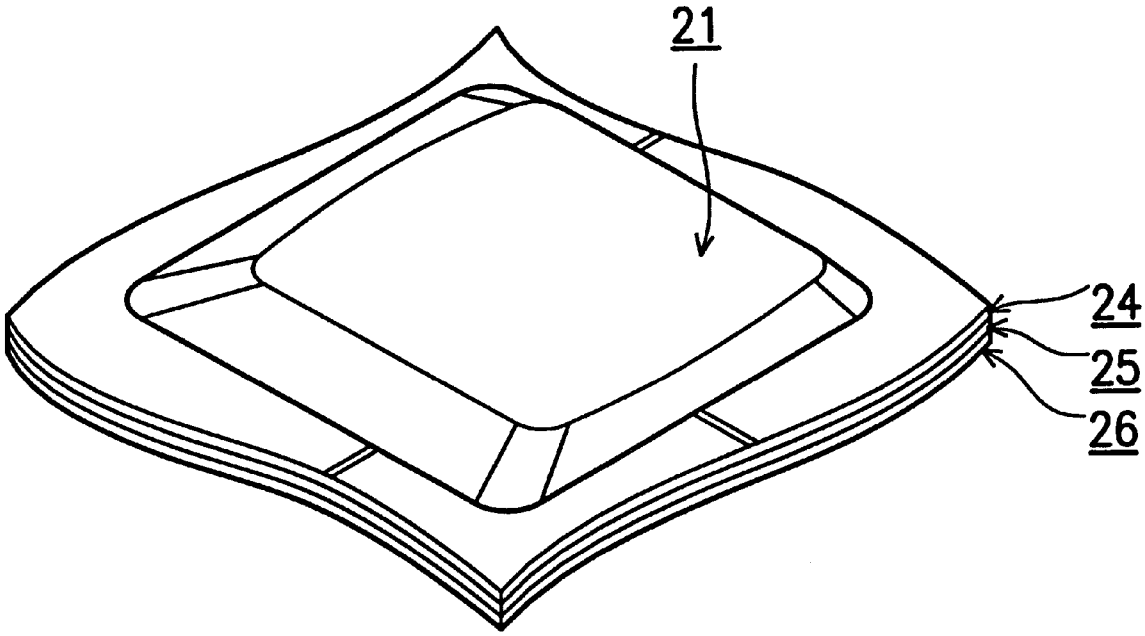
FIG. 5A is a perspective view showing the outer structure of a single key assembly (2-2) of a keyboard according to a second embodiment of the present invention.
Figure 5B:
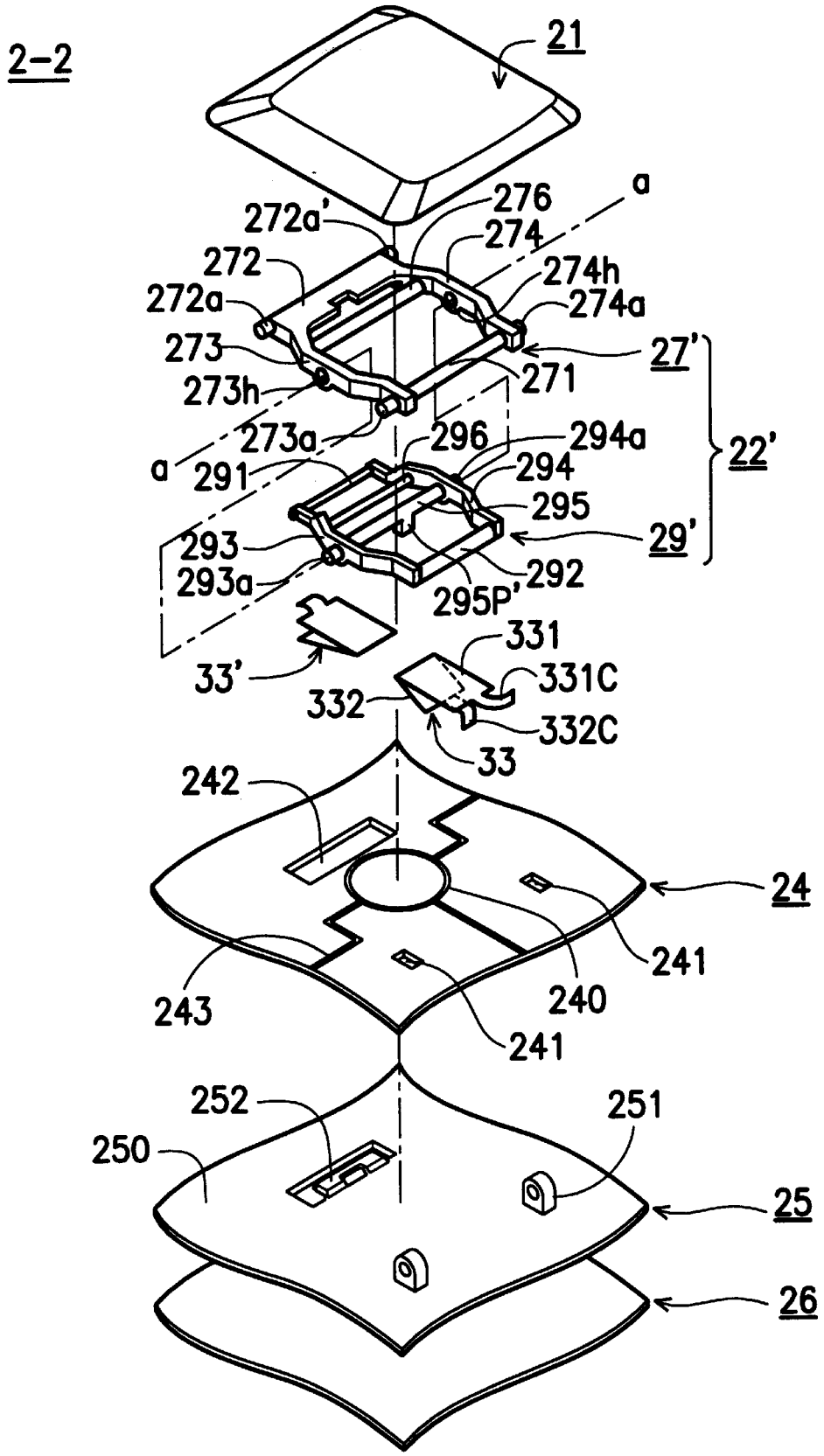
FIG. 5B is a perspective view showing all the elements of the key assembly (2-2) according to FIG. 5A.

FIG. 5A is a perspective view showing the outer structure of a single key assembly 2-2, and FIG. 5B is a perspective view showing all the elements of the key assembly 2-2 according to FIG. 5A.

The second embodiment is identical to the first embodiment except as follows. In FIG. 5B, two V-shaped resilient elements 33 (33') are used to replace the U-shaped resilient element 23 in FIG. 1B. Each of two V-shaped resilient elements 33 (33') is a folded reed element constructed by a first portion 331 and a second portion 332, and the free ends of the first portion 331 and the second portion 332 are respectively provided with two connecting ports 331C (332C). A guiding portion 295P', longer than the guiding portion 295P of the first embodiment, is formed at the middle of the bar 295 of a second linking bracket 29' of a scissors-type linkage 22'. The guiding portion 295P' is used as a triggering portion to directly actuate the switch 240 of the circuit membrane 24 as the key cap 21 is pushed.

Figure 6:
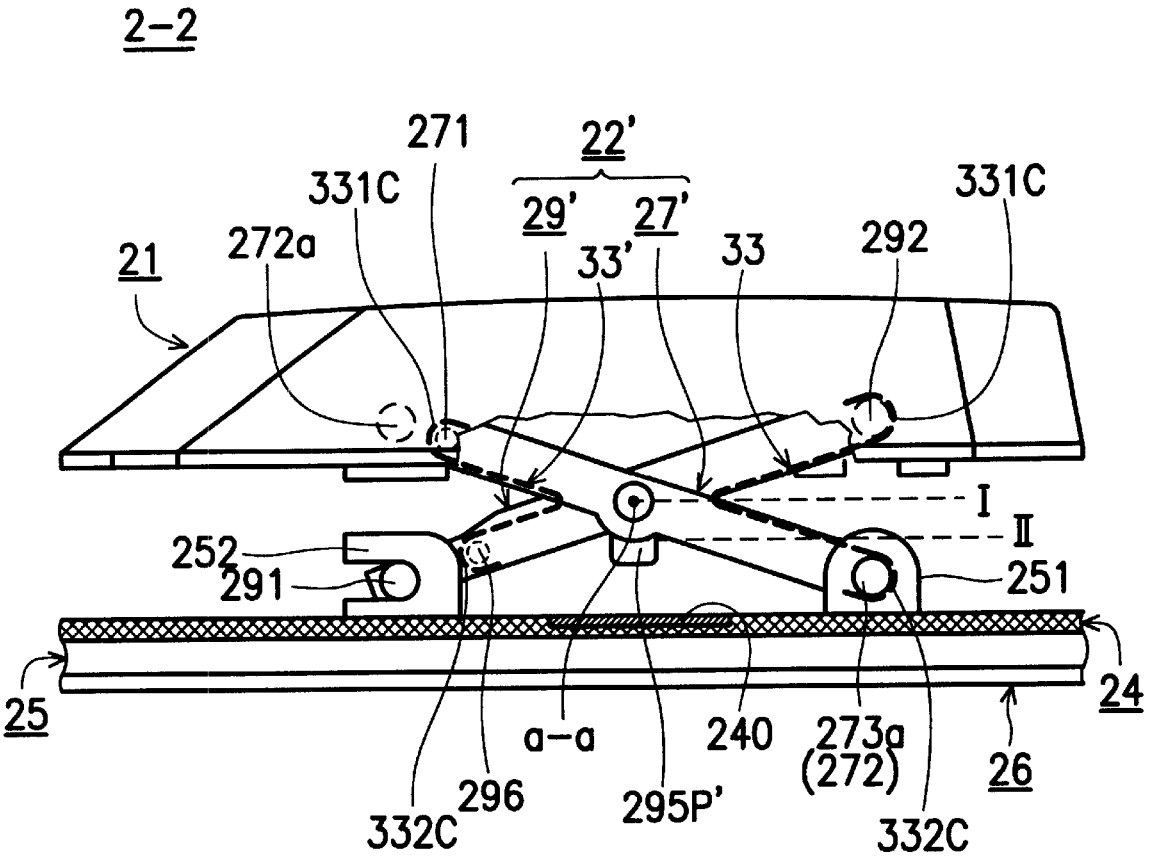
FIG. 6 is a side view showing the assembled key assembly (2-2) according to FIG. 5B.

In FIG. 6, a side view is shown that the assembled key assembly (2-2) of FIG. 5B. The V-shaped resilient element 33 is mounted on the scissors-type linkage 22' by connecting it's connecting ports 331C (332C to the bars 292 of the second linking bracket 29' and the bars 272 of the first linking bracket 27, respectively. The V-shaped resilient element 33' is also mounted on the scissors-type linkage 22' by connecting it's connecting ports 331C (332C) to the bars 271 of the first linking bracket 27 and the, bars 296 of the second linking bracket 29'.

When the key cap 21 is pushed, the pressed key cap 21 actuates the scissors-type linkage 22 to compress the two V-shaped resilient elements 33 (33'), and then the switch 240 can be turned on by the trigger of the guiding portion 295P' as the pivotal axis a—a is arrived at the second position II. When the force on the key cap 21 is removed, the two deformed V-shaped resilient elements 33 (33') are immediately returned to the initial state and releases the stored energy to dynamically push the scissors-type linkage 22' back to the initial state, and the switch 240 is immediately turned off as the guiding portion 295P' is removed.

Third/Fourth Embodiments

Figure 7A:
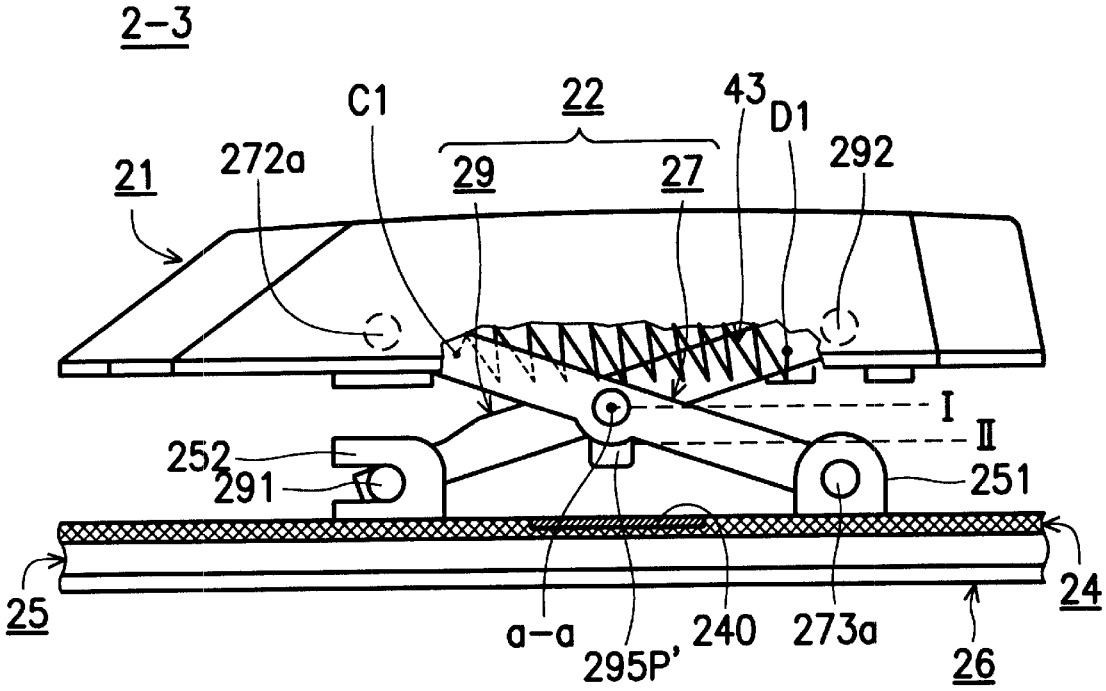
FIG. 7A is a side view showing an assembled key assembly (2-3) according a third embodiment of the present invention.
Figure 7B:
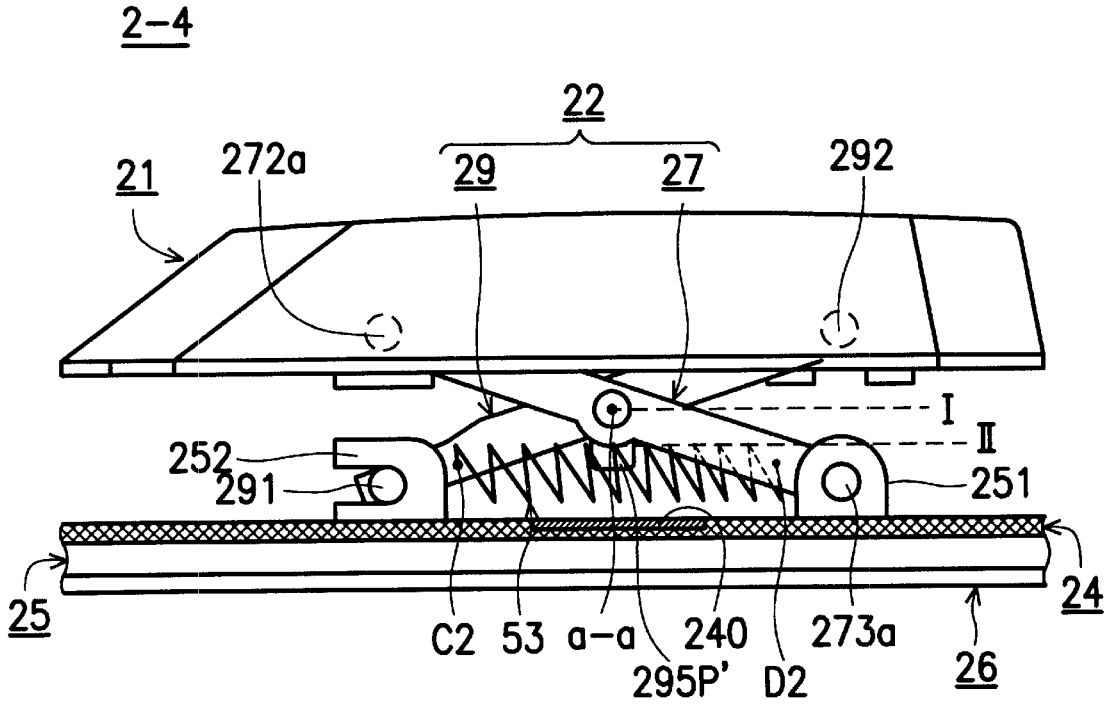
FIG. 7B is a side view showing an assembled key assembly (2-4) according a fourth embodiment of the present invention.
Figure 1B:
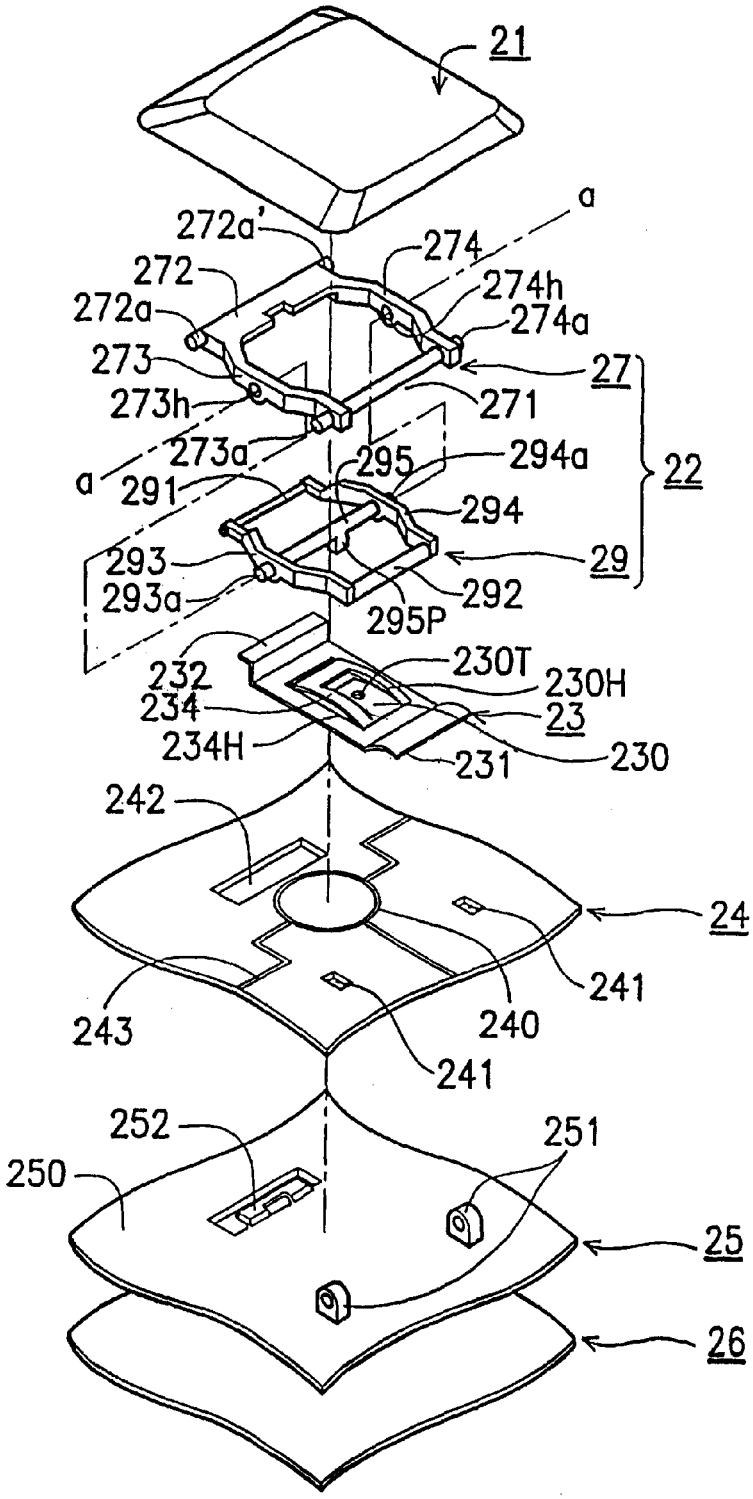
Figure 4A:
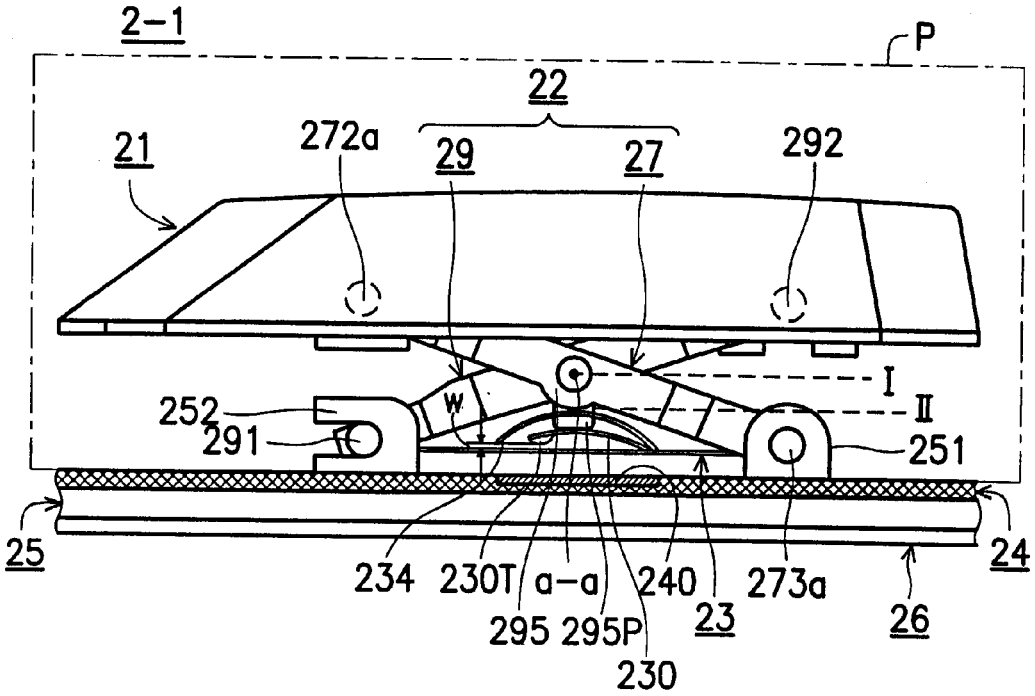
Figure 4B:
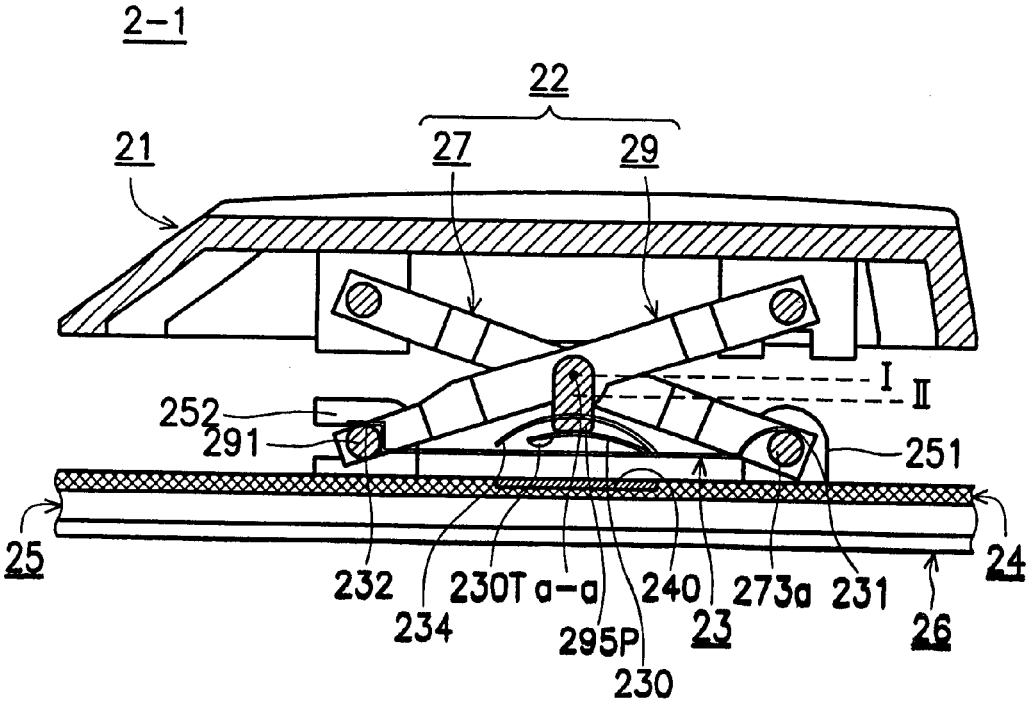

In FIG. 7A and FIG. 7B, two sets of assembled key assemblies 2-3 and 2-4 are provided by a third and a fourth embodiment of the present invention. The structure of both of the key assemblies 2-3 and 2-4 is based on the one of the aforementioned key assembly 2-2, and the difference is that two springs 43 (53) are applied by the key assemblies 2-3 and 2-4 instead of the two V-shaped resilient elements 33 (33').

In FIG. 7A, the spring 43 is singly mounted on the scissors-type linkage 22' near the key cap 21 by connecting its two ports C1 and D1 to the first linking bracket 27 and the second linking bracket 29', respectively. In FIG. 7B, the spring 53 is mounted on the scissors-type linkage 22' near the circuit membrane 24 by connecting its two ports C2 (D2) to the first linking bracket 27 and the second linking bracket 29', respectively.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A switch device, comprising:

a base plate;

a key cap;

a scissors-type linkage disposed between the key cap and the base plate to make the key cap move along a specified path between a first position and a second position, having a first linking bracket provided with at least a first end connected to the base plate and at least a second end connected to the key cap, a second linking bracket coupled with the first linking bracket and provided with at least a third end connected to the base plate and at least a fourth end connected to the key cap; and a resilient element for moving the key cap from the second position to the first position, having a first mounting port mounted on the first linking bracket and a second mounting port mounted on the second linking bracket.

2. The switch device as claimed in claim 1 further comprising a circuit membrane provided with at least one switch and disposed-between the base and the resilient element.

3. The switch device as claimed in claim 1, wherein the resilient element has a cantilever arm provided with a trigger and the scissors-type linkage has a guiding portion.

4. The switch device as claimed in claim 1, wherein the resilient element has at least one arc portion.

5. The switch device as claimed in claim 1, wherein the resilient element is a reed.

6. The switch device as claimed in claim 1, wherein the resilient element is a V-shaped reed.

7. The switch device as claimed in claim 1, wherein the resilient element is a spring.

8. A switch device, comprising:

a baseplate;

a key cap;

a scissors-type linkage disposed between the key cap and the base plate and to make the key cap moving along a specified path between a first position and a second position, having a first linking bracket provided with at least a first end connected to the base plate and at least a second end connected to the key cap, a second linking bracket coupled with the first linking bracket and provided with at least a third end connected to the base plate at least a fourth end connected to the key cap; and a resilient element provided with an arc portion in contact with the scissors-type linkage during depression of the switch device, a cantilever arm disposed in the arc portion, and first and second mounting ports mounted to the first and second linking brackets, wherein the arc portion resists depression of the scissors-type linkage to resist depression of the keycap.

9. The switch device as claimed in claim 8 further comprising a circuit membrane provided with at least one switch and disposed between the base and the resilient element.

10. The switch device as claimed in claim 8, wherein the cantilever arm is provided with a trigger and the scissors-type linkage has a guiding portion.

11. The switch device as claimed in claim 8, wherein the scissors type linkage contains a bar in contact with the arc portion, wherein the arc portion resists depression of the bar to resist depression of the keycap.

12. The switch device as claimed in claim 8, wherein the resilient element is a reed.

13. The switch device as claimed in claim 8, wherein the resilient element is a V-shaped reed.

14. The switch device as claimed in claim 8, wherein the resilient element is a spring.

* * * * *

UNITED STATES PATENT AND TRADEMARK OFFICE

CERTIFICATE OF CORRECTION

PATENT NO. : 6,504,120 B2
DATED : January 7, 2003
INVENTOR(S) : Chien-Shih Hsu

It is certified that error appears in the above-identified patent and that said Letters Patent is hereby corrected as shown below:

Drawings,
Delete Drawing Sheets 2 of 9 and 4 of 9 and substitute therefore the attached Drawing Sheets 2 of 9 and 4 of 9.

Signed and Sealed this

Twentieth Day of September, 2005

JON W. DUDAS
*Director of the United States Patent and Trademark Office*